US006305290B1

(12) United States Patent
Stimmell et al.

(10) Patent No.: US 6,305,290 B1
(45) Date of Patent: Oct. 23, 2001

(54) DUMMY AMMUNITION ROUND METHOD AND APPARATUS

(76) Inventors: James S. Stimmell, 7205 Milton Ave., Cocoa, FL (US) 32927-2940; Marshall F. Todd, 3730 Crossbow Rd., Cocoa, FL (US) 32926

( * ) Notice: Subject to any disclaimer, the term of this patent is extended or adjusted under 35 U.S.C. 154(b) by 0 days.

(21) Appl. No.: 09/587,872

(22) Filed: Jun. 6, 2000

(51) Int. Cl.[7] ..... F42B 8/00; F42B 30/00; F41A 33/00

(52) U.S. Cl. ..... 102/444; 102/439; 102/498; 102/502; 102/529; 434/24

(58) Field of Search ..... 102/439, 444, 102/446, 464, 498, 502, 507, 529; 42/96; 434/24

(56) References Cited

U.S. PATENT DOCUMENTS

| | | | | |
|---|---|---|---|---|
| 225,464 | * | 3/1880 | Coloney . | |
| 1,585,075 | * | 5/1926 | Boyce . | |
| 3,427,976 | * | 2/1969 | Lucy | 102/91 |
| 3,848,350 | * | 11/1974 | Seminiano | 42/1 N |
| 4,503,777 | * | 3/1985 | Young | 102/514 |
| 5,291,832 | * | 3/1994 | Plummer | 102/444 |
| 5,388,524 | * | 2/1995 | Strandli et al. | 102/529 |
| 5,488,909 | * | 2/1996 | Moser | 102/529 |
| 5,691,501 | * | 11/1997 | Gilbert | 102/444 |
| 6,189,454 | * | 2/2001 | Hunt | 102/444 |

FOREIGN PATENT DOCUMENTS 0 073 453-A1 * 8/1982 (EP) ..... F42B/13/20

* cited by examiner

*Primary Examiner*—Charles T. Jordan
*Assistant Examiner*—Kimberly S. Smith
(74) *Attorney, Agent, or Firm*—William M. Hobby, III

(57) ABSTRACT

The present invention is for a method of making a dummy ammunition round for a firearm which includes the steps of selecting a new or used metal casing of a used cartridge having a base end and an open end and then cutting an aperture in the base of the selected new or used metal casing. A polymer insert member is then formed having two end portions and shaped to fit into the selected metal casing with one end of the insert member having a protrusion sized to fit into the aperture cut through the casing base and the other end portion having a generally bullet shape for protruding from the open end of the metal casing. The formed polymer insert is then press fitted into the selected metal casing by press fitting the protrusion on one end into the aperture in the base of the metal casing and a portion between the ends being press fitted into the open end of the metal casing so that the bullet shaped end protrudes from the casing to thereby form a dummy bullet for practicing the clearing of malfunctions from semiautomatic and automatic firearms. The process can also include the steps of removing a used firing cap from the base of the selected metal casing by the drilling of the aperture into the casing. The polymer member can be formed by molding an ABS or other polymer into the predetermined shape. The polymer insert member has a ledge formed on one end portion adjacent the end portion protrusion to limit the insertion of the polymer insert member into the casing.

11 Claims, 1 Drawing Sheet

DUMMY AMMUNITION ROUND METHOD AND APPARATUS

This invention relates to a method of making a dummy ammunition round and specifically to the making of a dummy round for use during firearms training sessions by law enforcement agencies and the armed forces.

BACKGROUND OF THE INVENTION

Automatic and semi-automatic weapons, such as handguns and rifles, utilize the exhaust gases that result from the discharge of a round to chamber the next round. These gases apply force, in a rearward direction, to the weapon's bolt, forcing the bolt to travel in a rearward direction against the restraint of a spring. As the bolt is propelled backwards, an ejector mechanism engages the casing of the spent cartridge and ejects it. When the force applied by the gases against the bolt becomes less than the force of the spring, the bolt is returned to a closed position. As the bolt travels forward, it chambers the next round, if there is a round present. As the bolt travels in this fashion in most automatic or semi-automatic weapons, the bolt "cocks" the weapon by placing the firing mechanism in an armed position, ready to be fired by pulling the trigger. Thus, after each round is fired, the weapon is placed in condition to be fired a second time. A semi-automatic weapon may be fired as rapidly as the operator can pull the trigger. In an automatic weapon, the firing mechanism is automatically released as long as the trigger is being held back.

It is not uncommon for a weapon to malfunction when a cartridge misfires, or not fire at all. The bolt is prevented from properly ejecting the spent cartridge and from loading the next cartridge. Law enforcement agencies and the military train their personnel in the correct way to react to such an occurrence and to manually clear the malfunctioned cartridge and place the weapon in a condition to be fired. Personnel are trained to take steps to clear the weapon of the unfired or misfired cartridge and chamber the next round.

In order to simulate a misfire, a dummy round will be loaded in a clip, intermixed with live rounds, and the clip is loaded into a weapon to be fired. The dummy round will not fire when chambered and the shooter will have to react and clear the weapon of the dummy round.

In U.S. Pat. No. 2,405,308 to Jack, a dry firing cartridge has a separate bullet head and casing. This cartridge is provided with an internal piston, plate and integral spring that absorb the impact of the weapon's firing pin in order to prevent damaging the pin when the weapon is dry fired.

In U.S. Pat. No. 3,848,350 to Seminiano, a dry fire cartridge is disclosed that is constructed of a separate bullet head and casing. Seminiano discloses a soft, resilient material, which is injected into the primer cup, for absorbing the shock of the firing pin. Seminiano's dry fire cartridge is constructed of a standard spent casing that has been refitted with a standard bullet.

The Plummer U.S. Pat. No. 5,291,832 is for a dummy round for use in firearm training. The dummy round is loaded into a conventional semiautomatic or fully automatic weapon and is configured the same as a standard round of live ammunition. The casing portion and the bullet portion of the dummy round are constructed of a single integral unit.

In U.S. Pat. No. 4,450,769 to Moser, a dummy cartridge has a cartridge case containing a dummy projectile inserting into the cartridge case so as to bear against the case floor of the cartridge case. In U.S. Pat. No. 5,388,524 to Strandli et al., a practice projectile free of any explosives is adapted for shooting from aircraft against ground targets for target practice and includes a hollow shell having a projectile mounted therein. The base of the shell is a separate portion which engages the nose portion. The Moser U.S. Pat. No. 5,488,909 is a short range projectile which has a metal jacket which surrounds a plastic material core and is used for practice ammunition for firing over a predetermined short distance. The Hartley et al. U.S. Pat. No. 4,233,902 is a 76MM rammable practice cartridge while the Carlson U.S. Pat. No. 3,016,832 is a round for testing shotgun condition. The Boyce U.S. Pat. No. 1,585,075 is a toy cartridge while the Hobbs U.S. Pat. No. 119,357 is an improvement in cartridge shells for drill purposes and which includes a block of rubber to replace the firing cap on the cartridge casing. The Hannas et al. U.S. Pat. No. 3,027,840 relates to dummy ammunition cartridges which is susceptible to repeated use and for performing all the functions of a live cartridge.

In contrast, the present invention is for a method of making a dummy ammunition round for a firearm which is inexpensive and reliable and which can be utilized by law enforcement agencies to train personnel in the correct way to clear the weapon of an unfired or misfired cartridge and to rapidly chamber the next round.

Accordingly, it is an object of this invention to provide a dummy round which can be used as a training round and can be readily chambered and ejected from a conventional semiautomatic or fully automatic weapon.

SUMMARY OF THE INVENTION

The present invention is for a method of making a dummy ammunition round for a firearm which includes the steps of selecting a used or new metal casing of a used cartridge having a base end and an open end and then cutting an aperture in the base of the selected used metal casing. A polymer insert member is then formed having two end portions and shaped to fit into the selected metal casing with one end of the insert member having a protrusion sized to fit into the aperture cut through the casing base and the other end portion having a generally bullet shape for protruding from the open end of the metal casing. The formed polymer insert is then press fitted into the selected metal casing by press fitting the protrusion on one end into the aperture in the base of the metal casing and a portion between the ends being press fitted into the open end of the metal casing so that the bullet shaped end protrudes from the casing to thereby form a dummy bullet for practicing the clearing of malfunctions from semiautomatic and automatic firearms. The process can also include the steps of removing the used firing cap from the base of the selected metal casing and then drilling an aperture into the casing. The polymer member can be formed by molding a polyethylene or other polymer into the predetermined shape. The polymer insert member has a ledge formed on one end portion adjacent the end portion protrusion to limit the insertion of the polymer insert member into the casing.

BRIEF DESCRIPTION OF THE DRAWING

Other objects, features and advantages will be apparent to those skilled in the art upon reading the detailed description together with the drawings as described as follows.

DESCRIPTION OF THE PREFERRED EMBODIMENT

Figure 1:
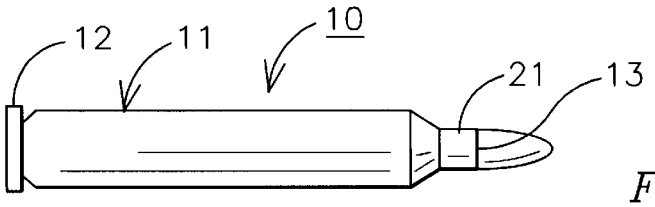
FIG. 1 is a side elevation of a dummy ammunition round in accordance with the present invention.
Figure 2:
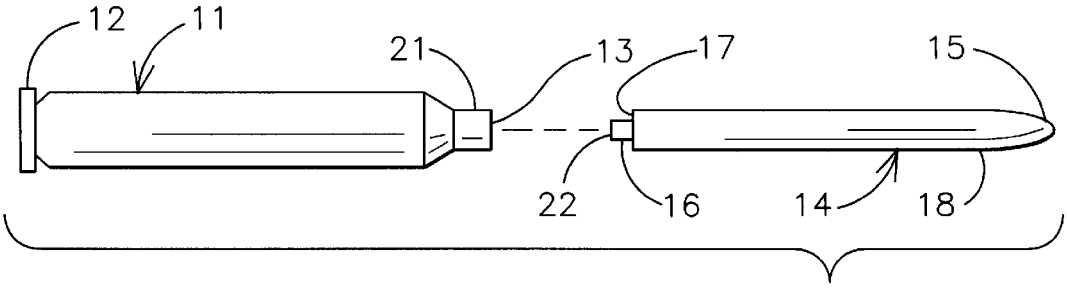
FIG. 2 is an exploded elevation of the dummy ammunition round of FIG. 1.
Figure 3:
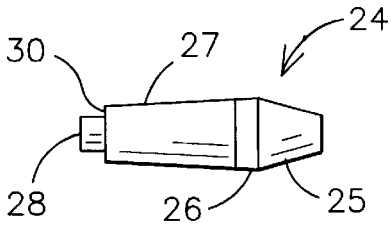
FIG. 3 is another embodiment of a polymer insert member for making a dummy ammunition round.
Figure 4:
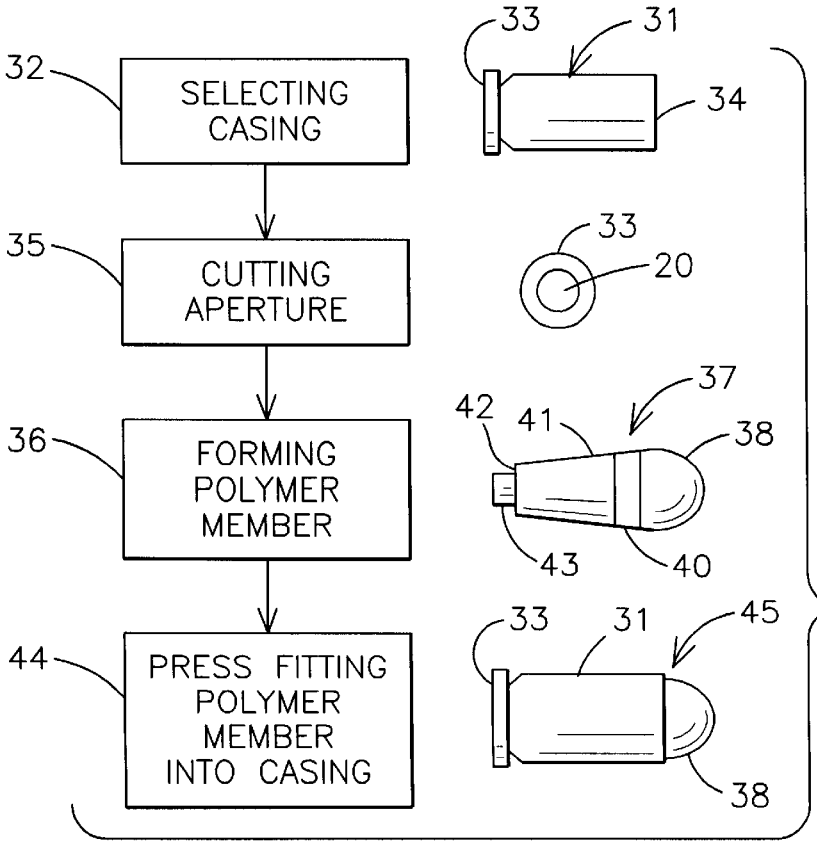
FIG. 4 is a flow diagram of the basic process of the present invention.

Referring to the drawings FIGS. 1–3, a dummy ammunition round 10 for a firearm is illustrated which is made for practicing the clearing of malfunctions from semi-automatic and automatic firearms. The dummy ammunition round 10 has a metal casing 11, which is made from a used ammunition round casing, and has a base 12 along with an open end 13. The used cartridge casing 11 is hollow since the round has already been fired or emptied of its charge. The base 12 has had the firing cap removed and a hole cut or drilled thereinto, as seen in FIG. 4. A formed plastic insert member 14 has a bullet-shaped end portion 15 on one end thereof and a protrusion 16 formed on the other end thereof with an annular ledge 17 defining the protrusion 16. The insert member 14 can be inserted into the cartridge casing 11 such that the protrusion 16 extends into the aperture drilled in the base 12 until blocked from further insertion by the ledge 17 at which point a press fit has been formed on the protrusion 16 by the aperture 20 of FIG. 4 and against an intermediate point 18 press fitted against the end portion 21 of the cartridge casing 11. A dummy round made in this fashion advantageously allows the round to be inserted into a clip or loaded into any semi-automatic or automatic weapon such that when it enters the chamber of the weapon, the firing pin of the weapon will strike against the end 22 of the protrusion 16 protruding through the aperture 20 in the metal cartridge 11. Since there is no firing cap or charge in the dummy cartridge 10, the weapon will malfunction to enable a person to learn the proper technique for clearing the malfunction and rechambering a live round into the weapon. Using a spent cartridge 11 with a plastic insert having a bullet end shape 15 allows the bullet to be loaded into the weapon along with the other bullets having the same shape. The elongated center portion 22 can be angled slightly in order to allow a smooth sliding of the polymer insert member 14 into the casing 11 until the point where the press fitting is to take place against the edge 18 and against the protrusion 16.

FIG. 3 shows another embodiment of a polymer insert member 24 having a bullet end portion 25, a press fitting ring portion 26, an angled or truncated cone shaped portion 27, and a protrusion 28 set off by an annular ledge 30. The insert 24 is for a different type of ammunition and has the angled surface 27 for allowing the insert to be inserted directly into a cartridge metal casing, such as the casing 31 of FIG. 4. The insert member 24 can have the protrusion 28 press fitted into the aperture 20 of a cartridge casing 31 of FIG. 4 and the surface 26 press fitting around the edge of the metal casing opening. The angled surface 27 allows the rapid insertion of the insert 24 to a point where the press fitting begins at both ends.

Turning to FIG. 4, the process of making a dummy ammunition round includes selecting (32) a used or new metal casing 31 having a base 33 and having an open end 34 and then cutting 35 an aperture 20 in the base 33 of the casing 31. The cutting can be performed by drilling or by punching or any other cutting technique desired. A drill can drill right through the used firing cap, or alternatively, the firing cap can be removed prior to drilling. The opening 20 is typically drilled larger than the firing cap.

The next step includes forming (36) a polymer insert member 37 having a bullet shaped end 38 and an annular press fitted area 40 along with a truncated cone or angled area 41 proceeding down to an annular ledge 42 where a predetermined sized protrusion 43 is formed on the other end of the polymer insert member 37. The forming can be by injection molding, machining, or any other technique desired and using any polymer desired, such as polyethylene or ABS. The formed insert member 37 is then placed in a cartridge casing 31 having the aperture 20 drilled thereinto the base 33 and the members press fitted 44 together to form the dummy bullet 45 having the bullet shaped end 38 protruding out one end of the metal casing 31 and in which the surface 40 has been press fitted around the interior of the opening of the casing 31 while the protrusion 43 is press fitted into the aperture 20 of the base 33.

It can be seen that the annular ledge 42 stops the polymer insert 37 from being inserted any further into the casing 31 by lodging itself against the inside of the base 30 as the protrusion 43 is inserted through the aperture 20. The dummy cartridge 45 thereby has the insert member 37 press fitted at both ends of the casing 31.

It should be clear at this time that a dummy ammunition round and a method of making a dummy ammunition round have been provided for use in practicing the clearing of a malfunction in a semi-automatic or automatic firearm. However, the present invention should not be construed as limited to the form shown which are to be considered illustrative rather than restrictive.

What is claimed is:

1. A method of making a dummy ammunition round for a firearm comprising the steps of:

selecting a metal casing of a cartridge having a base end and an open end;

cutting an aperture in the base of said selected metal casing;

forming a polymer member having two end portions and being shaped to fit into said selected metal casing, one end portion having a protrusion sized to fit into said aperture in said casing base and the other end portion having a generally bullet shape;

press fitting said formed polymer member into said selected metal casing with said one end portion extending into said cut aperture and the other end portion extending from said metal casing open end to thereby form a dummy bullet for practicing the clearing of malfunctions from semi-automatic firearms.

2. The method of making a dummy ammunition round for a firearm in accordance with claim 1 in which the step of selecting a metal casing includes selecting a used metal casing of a cartridge.

3. The method of making a dummy ammunition round for a firearm in accordance with claim 2 including the step of removing a used firing cap from the base of said selected used metal casing by cutting an aperture in said casing.

4. The method of making a dummy ammunition round for a firearm in accordance with claim 1 in which the step of cutting an aperture in the base of said selected metal casing includes drilling an aperture in said casing.

5. The method of making a dummy ammunition round for a firearm in accordance with claim 1 in which the step of forming a polymer member includes molding a polymer member.

6. The method of making a dummy ammunition round for a firearm in accordance with claim 5 in which the step of forming a polymer member includes forming a polymer member of ABS.

7. The method of making a dummy ammunition round for a firearm in accordance with claim 1 in which the step of press fitting said formed polymer member into said selected metal casing includes press fitting said polymer one end portion protrusion into said metal casing aperture.

8. The method of making a dummy ammunition round for a firearm in accordance with claim 7 in which the step of press fitting said formed polymer member into said selected metal casing includes press fitting a portion of said polymer other end portion into said casing open end.

9. The method of making a dummy ammunition round for a firearm in accordance with claim 8 in which the step of forming a polymer member includes forming a polymer member having an angled middle portion between said two end portions.

10. The method of making a dummy ammunition round for a firearm in accordance with claim 8 in which the step of forming a polymer member includes forming a polymer member having an annular ledge formed adjacent said one end portion protrusion to thereby limit the insertion of said polymer member protrusion into said aperture cut into said metal casing.

11. A dummy ammunition round for a firearm comprising:

a metal casing of an ammunition cartridge having a base end having an aperture cut therethrough; and a formed polymer member attached through said metal casing to form a dummy round, said formed polymer member having two end portions and being shaped to fit into said metal casing, and having one end portion having a protrusion fitted into said aperture casing base and an annular ledge lodged against said case base and said polymer member other end portion having a generally bullet shaped end protruding from said metal casing and said polymer member also having an angled middle portion whereby a dummy bullet can be used for practicing the clearing of malfunctions from semi-automatic and automatic firearms.

* * * * *